US009603423B1

(12) United States Patent
Skobeleva

(10) Patent No.: US 9,603,423 B1
(45) Date of Patent: Mar. 28, 2017

(54) NETTING ENCLOSURE FOR AN UMBRELLA

(71) Applicant: Sharon Skobeleva, Brooklyn, NY (US)

(72) Inventor: Sharon Skobeleva, Brooklyn, NY (US)

( * ) Notice: Subject to any disclaimer, the term of this patent is extended or adjusted under 35 U.S.C. 154(b) by 0 days.

(21) Appl. No.: 15/069,346

(22) Filed: Mar. 14, 2016

(51) Int. Cl.
*A45B 25/18* (2006.01)
*E04H 15/28* (2006.01)
*A45B 25/00* (2006.01)

(52) U.S. Cl.
CPC ..... *A45B 25/18* (2013.01); *E04H 15/28* (2013.01); *A45B 2025/003* (2013.01)

(58) Field of Classification Search
CPC ... A45B 15/00; A45B 2025/003; A45B 25/18; E04H 15/28
USPC ..... 135/33.2, 33.41; 160/349.1
See application file for complete search history.

(56) References Cited

U.S. PATENT DOCUMENTS 1,774,909 A * 9/1930 Wells ..... A45B 23/00 135/15.1
2,173,993 A * 9/1939 Amdur ..... A47K 3/38 160/349.1
2,221,366 A * 11/1940 Bisbing ..... E04H 15/28 135/117
2,319,292 A * 5/1943 Boggs ..... A41D 3/08 135/119
2,652,845 A * 9/1953 O'Neill ..... E04H 15/003 135/120.1
2,863,467 A * 12/1958 Hearell ..... E04H 15/003 135/114
2,943,634 A * 7/1960 Morgan ..... E04H 15/003 135/118
3,224,495 A * 12/1965 Truesdale ..... A47H 23/01 160/349.1
3,419,024 A * 12/1968 Nickerson, Jr. ..... E04H 1/1244 135/120.1
3,477,453 A 11/1969 D'Ulisse et al.
3,827,019 A * 7/1974 Serbu ..... A41F 1/002 135/117
4,142,570 A * 3/1979 Heimberg ..... A47H 23/01 160/349.1
5,172,712 A * 12/1992 Robinson ..... E04H 15/28 135/33.41
5,664,595 A 9/1997 Vonderhorst et al.
5,678,587 A * 10/1997 Bilotti ..... E04H 15/28 135/16

(Continued)

OTHER PUBLICATIONS

"Ideaworks JB5678 Outdoor 9-Foot Umbrella Table Screen, Black," https://www.amazon.com/Ideaworks-JB5678-Outdoor-9-Foot-Umbrella/dp/B0031R1TKM, Amazon.com.

*Primary Examiner* — Noah Chandler Hawk
(74) *Attorney, Agent, or Firm* — Douglas R. Smith, Esq.; Woods Oviatt Gilman LLP

(57) ABSTRACT

An adjustable, removable mesh canopy is adapted to fit umbrellas and parasols while providing a barrier to mosquitoes and other insects. A removable weight may be affixed to the bottom of the net to keep the net flush with the ground during movement and wind and to inhibit insect entry into the enclosed space. The top includes an adjustable drawstring opening which can be adjusted to fit umbrellas or parasols that vary in diameter. A closed seam runs down the side, and a resealable opening may be installed on the side of the net so that a user can temporarily extend a hand outside of the net through the opening.

14 Claims, 4 Drawing Sheets

(56) References Cited

U.S. PATENT DOCUMENTS

| | | | | |
|---|---|---|---|---|
| 5,806,547 | A * | 9/1998 | Derlinga | A45B 23/00 135/117 |
| 6,009,891 | A | 1/2000 | Surface et al. | |
| 7,909,051 | B2 * | 3/2011 | Victory | D06F 57/04 135/119 |
| 8,042,561 | B2 * | 10/2011 | Moravec Varga | A45B 15/00 135/16 |
| 8,079,378 | B1 * | 12/2011 | Derlinga | A45B 23/00 135/16 |
| 8,550,099 | B2 * | 10/2013 | Essex | A42B 1/18 135/16 |
| 8,695,194 | B2 * | 4/2014 | Kress | A47H 23/00 112/475.06 |
| 9,057,206 | B2 | 6/2015 | Lin | |
| 2005/0011134 | A1 * | 1/2005 | Boltan | E04H 15/28 52/3 |
| 2005/0028851 | A1 * | 2/2005 | Knoepp | A45B 25/20 135/15.1 |
| 2006/0102216 | A1 * | 5/2006 | You | E04H 15/001 135/90 |

* cited by examiner

NETTING ENCLOSURE FOR AN UMBRELLA

FIELD OF THE INVENTION

The present invention relates to a netting enclosure for an umbrella; in particular, to a netting enclosure comprised of a generally cylindrical length of mesh material having a top end configured to be removably mounted upon an umbrella or parasol canopy and a bottom end configured to removably receive a weighting unit so as to keep the enclosure at or near the ground during use. More particularly, the present invention relates to a netting enclosure for an umbrella that is lightweight, compact, portable and easily deployable to protect the user from winged insects such as flies, bees or mosquitos.

BACKGROUND OF THE INVENTION

Netting enclosures designed to prevent ingress of flying insects, such as flies, bees or mosquitos are known in the art. For instance, netting enclosures are readily available for use with outdoor patio sets. Patio enclosures typically employ a frame unit defining the perimeter of the resultant enclosure with netting material then mounted to the frame unit to provide screened walls. The top of the frame may also include netting material or may include an opaque covering so as to provide shade or protection from the sun. The netting material constituting one wall may also include a separable seam thereby permitting entry into and/or egress from the enclosure interior. The bottom portion of the netting material forming each wall may also be fixed to the ground through a series of stakes or may include a fixed weight sewn into the netting material to prevent the walls from becoming dislocated by wind. While these enclosures may provide desired protection from flying insects, they are fixed structures requiring persons desiring such protection to remain within the stationary enclosure.

In an attempt to provide ambulatory protection, netting enclosures have also been developed for use with conventional personal umbrellas. Similar to patio enclosures described above, these umbrella enclosures are mounted onto an umbrella canopy such that netting material drapes to the ground. The netting material may include fixed weights along its bottom periphery to prevent unwanted displacement of the netting material during use. However, present umbrella-based netting disclosures suffer a number of drawbacks, such as being bulky, heavy and/or not easily deployable when needed and subject to failure of protection due to open seams within the draped netting.

As such, there is a need for a netting apparatus that is lightweight, compact, portable and easily deployable to protect the user from winged insects such as flies, bees or mosquitos. The present invention addresses these and other needs.

BRIEF SUMMARY OF THE INVENTION

In general, one aspect the present invention is directed to a netting apparatus configured to create an enclosure when mounted upon an opened canopy of an umbrella. The netting apparatus comprises a length of netting having a top opening defined by a top edge and a bottom opening defined by a bottom edge. The length is sufficient to extend from a portion of the opened canopy to substantially near the ground. The top edge includes a drawstring to cinch the top edge thereby configuring the top opening to have a smaller diameter than the opened canopy. The bottom edge is configured to removably receive a weight unit when the netting apparatus is mounted upon the opened canopy so as to place the bottom edge substantially near the ground and thereby create the enclosure. The netting apparatus is also configured to have the weight unit removed from the netting apparatus when the netting apparatus is not mounted to the opened canopy of the umbrella.

A further aspect of the present invention is directed to a netting apparatus configured to create an enclosure when mounted upon an opened canopy of an umbrella. The netting apparatus comprises a length of netting having a top opening defined by a top edge and a bottom opening defined by a bottom edge. The length is sufficient to extend from a portion of the opened canopy to substantially near the ground. A portion of the netting includes a seam defining an opening releasably joined together by a fastener. The top edge includes a drawstring to cinch the top edge thereby configuring the top opening to have a smaller diameter than the opened canopy. The bottom edge is crenellated so as to form a series of alternating recesses and tabs of netting where each respective tab of netting is formable to create a pocket configured to removably receive a respective weight unit when the netting apparatus is mounted upon the opened canopy so as to place the bottom edge substantially near the ground and thereby create the enclosure. The netting apparatus is also configured to have the weight units removed from the netting apparatus when the netting apparatus is not mounted to the opened canopy of the umbrella.

In still another aspect of the present invention, a netting apparatus is configured to create an enclosure when mounted upon an opened canopy of an umbrella. The netting apparatus comprises a length of netting having a top opening defined by a top edge and a bottom opening defined by a bottom edge. The length is sufficient to extend from a portion of the opened canopy to substantially near the ground. A portion of the netting includes a seam defining an opening releasably joined together by a fastener. The top edge includes a drawstring to cinch the top edge thereby configuring the top opening to have a smaller diameter than the opened canopy. The bottom edge is folded back upon the netting to form an overlapped portion, the overlapped portion having a plurality of parallel, spaced apart seams normal to the bottom edge so as to define a plurality of pockets. Each respective pocket is configured to removably receive a respective weight unit when the netting apparatus is mounted upon the opened canopy so as to place the bottom edge substantially near the ground and thereby create the enclosure. The netting apparatus is also configured to have the weight units removed from the netting apparatus when the netting apparatus is not mounted to the opened canopy of the umbrella.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
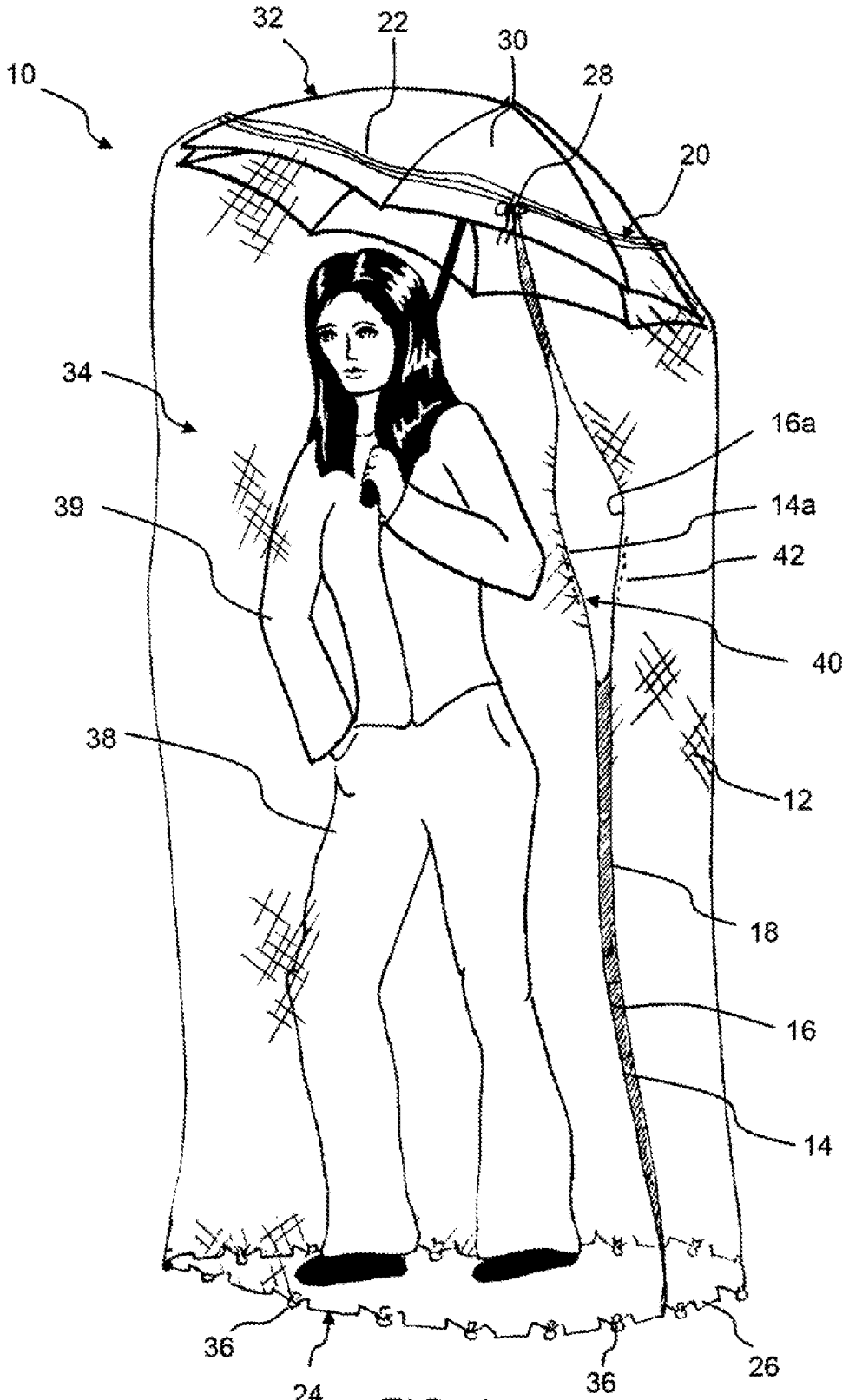
FIG. 1 is a perspective side view of a netting apparatus in accordance with an embodiment of the present invention, the netting apparatus mounted upon the open canopy of a conventional umbrella.
Figure 2:
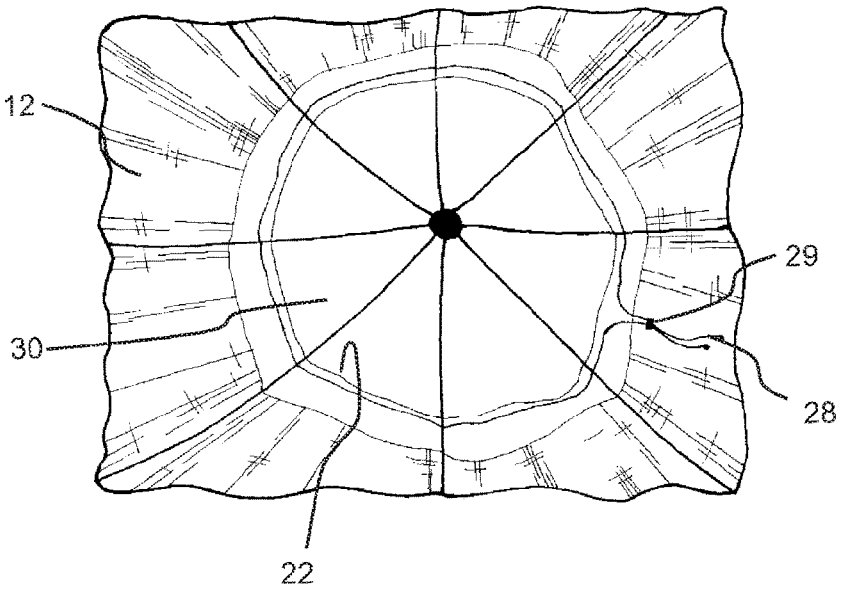
FIG. 2 is a partial expanded top view of the netting apparatus shown in FIG. 1 as mounted upon an umbrella canopy.

Referring to the drawings in detail, and specifically to FIG. 1, an embodiment 10 of a netting apparatus and associated umbrella 32 is shown. Netting apparatus 10 may be generally comprised of a length of netting 12 having an opposing left edge 14 and right edge 16. Left edge 14 and right edge 16 may be joined together at a fixed seam 18 so as to construct a generally cylindrical netting having a top opening 20 defined by top edge 22 and a bottom opening 24 defined by bottom edge 26. Top edge 22 may be hemmed to include a drawstring 28 which is used to cinch top edge 22 and thereby adjust the diameter of top opening 20 (see also FIG. 2). Drawstring 28 may be tied in a knot or bow or may also include a cord lock 29 to control cinching of top edge 22. As a result, top edge 22 may be cinched such that it rests atop canopy 30 of a conventional umbrella 32 such that netting 12 drapes downwardly about a user 38 and bottom edge 26 rests substantially near the ground. As used herein, the phrase "substantially near the ground" shall mean just touching the ground or within about 1 inch of just touching the ground. In this manner, during use of netting apparatus 10 (as shown in FIG. 1), flying insects will be significantly prohibited from entering enclosure 34 defined by umbrella 32 and netting 12 while also minimizing to potential for tripping or stepping upon netting 12. While drawstring 28 permits some control over the vertical length of netting 12 with respect to where bottom edge 26 is located in reference to the ground, it should be understood by those skilled in the art that the length of netting 12 may be any suitable length depending upon external variables, such as user height and canopy diameter.

As shown generally in FIG. 1, bottom edge 26 may be configured to removably receive a plurality of respective weight units 36 so as to aid netting 12 in remaining substantially near the ground during movement of user 38 and/or when netting 12 is exposed to wind. Bottom edge 26 will be described in more detail below with regard to FIGS. 3-5. As a result, user 38 may freely move about without compromising the protection from flying insects sought to be afforded by netting apparatus 10. Seam 18 may also include a selectively openable portion 40 wherein a length 14*a* of left edge 14 and a corresponding length 16*a* of right edge 16 are adapted to include mating halves of releasable fastener 42. By way of example and by no means limiting solely thereto, fastener 42 may be any suitable fastener, such as a button, a zipper, hook-and-loop material, magnets, snaps, clips, ties and the like. Selectively openable portion 40 may be located along seam 18 so that selectively openable portion 40 is not coterminous with either top edge 22 or bottom edge 26. Moreover, selectively openable portion 40 may be vertically positioned so as to coincide with an outstretched arm 39 of user 38. The length of selectively openable portion 40 may also be limited, such as to form an opening less than about 6 inches in length, such that incorporation of fastener 42 within the netting 12 does not unevenly weight the netting draped from canopy 30 which may cause user discomfort and fatigue. In this manner, user 38 may manipulate objects outside of enclosure 34 by passing only arm 39 through the opening formed by uncoupling fastener 42 on length 14*a* and length 16*a*. This, in turn, minimizes user exposure to flying insects, such as fly, bees or mosquitos. Upon retracting the arm within enclosure 34, fastener 42 may be refastened so as to reestablish integrity of netting 12. It should be noted that, while shown and described as a generally rectangular length of webbing, any suitable geometry of webbing may be used so long as such length has a top opening including a drawstring and a bottom opening adapted to removably receive one or more weight units.

Figure 3:
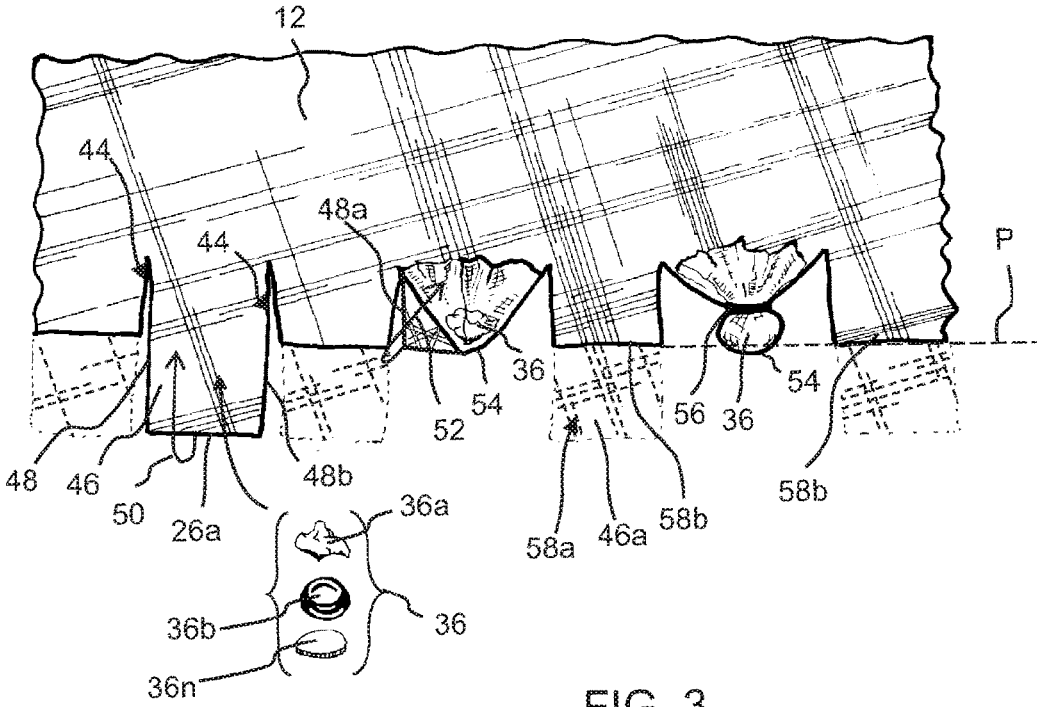
FIG. 3 is a partial expanded view of one embodiment of a bottom edge of the netting apparatus shown in FIG. 1 sequentially showing removable affixation of a weight unit to the netting apparatus.

Turning now to FIG. 3, an expanded view of an embodiment of a bottom edge 26*a* that may be used within netting apparatus 10 is shown. Bottom edge 26*a* may include a plurality of spaced parallel slits 44 cut normal to the plane created by bottom edge 26*a*. Slits 44 create a number of downwardly extending tabs 46 having opposing left and right edges 48*a*, 48*b*, respectively. A respective weight unit 36 may be placed within the portion of netting 12 defined by a respective tab 46. It should be noted that not all tabs are required to receive a weight unit. Rather, the number and placement of individual weight units may be dictated solely by the user. With weight unit 36 placed on a tab 46, bottom edge 26*a* may be folded upwardly as generally indicated by arrow 50. Each of right edge 48*b* and left edge 48*a* may be folded inwardly, such as generally indicated by arrow 52, to form pocket 54 within which resides weight unit 36. It should be noted that edges 48*a* and 48*b* may be folded prior to folding bottom edge 26*a*. A closure 56 may then be secured about the netting above weight unit 36 so as to maintain pocket 54 in a closed condition. In this manner, weight unit 36 is secured to netting 12 via pocket 54 so as to aid in preventing unwanted dislocation of netting apparatus 10 while the user is moving about or during heavy winds.

Weight unit 36 may be any suitable object, and preferably has a mass between approximately 2 grams and 10 grams, and more preferably a mass of about 5 grams. Non-exhaustive examples of possible objects suitable for use as a weight unit 36 include a coin 36*a*, a small rock or pebble 36*b* or a marble 36*n*. It should be understood by those skilled in the art that any object having the proper size and weight may be used as a weight unit. In accordance with an aspect of the present invention, weight units 36 may be any suitable item readily at hand when user 38 deploys netting apparatus 10. In this manner, user 38 does not need to carry the additional weight of fixed weight units but need only carry the reduced weight of the netting material without weight units. Eliminating fixed weights also promotes compact storage and transport of netting apparatus 10 when not deployed. As such netting apparatus 10 may be conveniently carried in a pocket or handbag when not in use.

Additionally, by way of example, and by no means limiting thereto, slits 44 may be about 4 inches long and spaced about 4 inches apart from a next successive slit. In this manner, two successive slits 44 create a tab 44 of approximately 4 inches by 4 inches square which may be sufficient to form pocket 54 having dimensions suitable for receiving a weight unit 36, such as coin 36*a*, small rock or pebble 36*b* or marble 36*n*. Also, without limiting solely thereto, closure 56 may be a string tie, a twist tie, a rubber band, a cord lock, an adhesive tape, a hook-and-loop fastener band and the like. When use is no longer required, the releasable closures may be removed and the weight units may be discarded. Netting 12 may then be compactly folded and secured in its folded condition by the releasable closures. As a result, netting apparatus may be manufactured and shipped and without weights being affixed to the netting. This also enables users to carry an unused netting apparatus upon their person without having to bear the cumulative weight of numerous weights.

With continued reference to FIG. 3, in a further aspect of the invention, a portion 46*a* (shown in dotted line) of every second tab 46 may be removed so as to create a crenellated bottom edge of alternating recesses 58*a* having a bottom edge 58*b* and full tabs 46 having bottom edge 26*a*. Portion 46*a* may be removed from tab 46 approximately half way along the length of respective adjacent slits 44. Thus, continuing the above example, each respective bottom edge 58*b* may be about 2 inches higher than bottom edge 26*a*. A weight unit 36 may be placed upon full tab 46, with full tab 46 then being folded roughly in half as generally indicated by arrow 50. Sides 48*a* and 48*b* are then folded inwardly to create pocket 54 and secure weight unit 36 within the pocket by closure 56 as described above. In this manner, pocket 54 may lie generally within the same plane P created by successive bottom edges 58*b* thereby creating a generally uniform bottom edge which may promote less tripping or stepping upon the netting material or weighted pockets.

Figure 4:
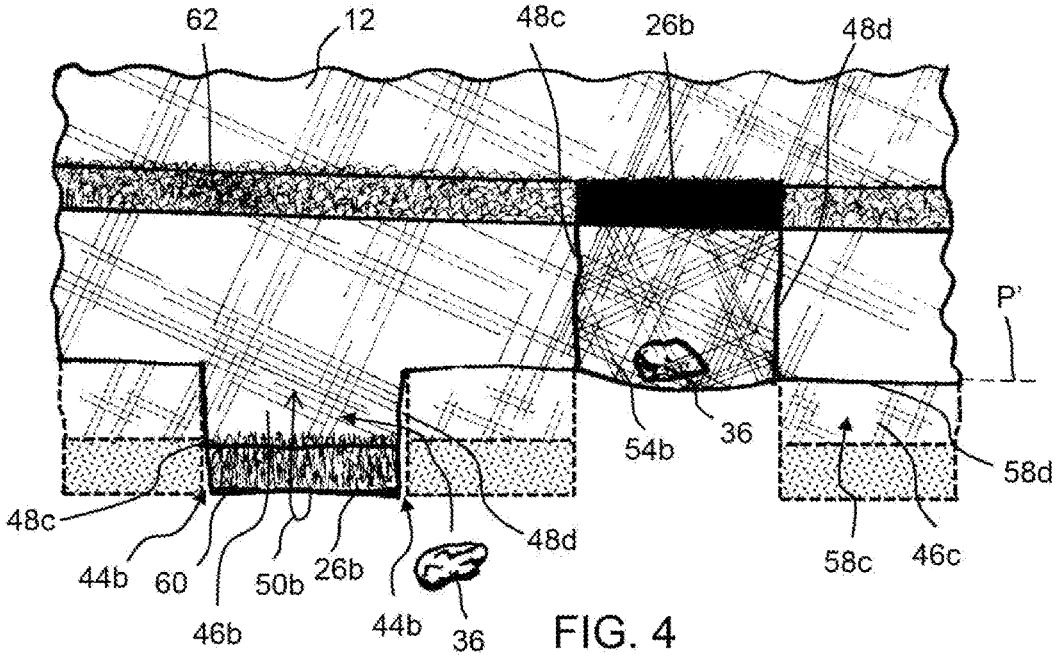
FIG. 4 is a partial expanded view of an alternative embodiment of a bottom edge of the netting apparatus shown in FIG. 1.

FIG. 4 shows an expanded view of an alternative bottom edge 26*b* that may be used within netting apparatus 10. Similar to bottom edge 26*a* described above, bottom edge 26*b* may include a plurality of spaced parallel slits 44*b* cut normal to the plane created by bottom edge 26*b* to thereby create a number of downwardly extending tabs 46*b* having opposing left and right edges 48*c*, 48*d*, respectively. A respective weight unit 36 may be placed within the portion of netting 12 defined by a respective tab 46*b*. With weight unit 36 placed on a tab 46*b*, bottom edge 26*b* may be folded upwardly as generally indicated by arrow 50*b* to form pocket 54*b* within which resides weight unit 36. Each tab 46*b* may include a resealable closure device 60 proximate bottom edge 26*b*. To facilitate and maintain closure of pocket 54*b*, netting 12 may include a corresponding resealable closure device 62 configured to mate with releasable closure device 60. By way of example and by no means limiting solely thereto, resealable closure devices 60 and 62 may be any suitable device, such as a hook-and-loop material, a self-adhesive material, magnets, buttons, zippers, snaps, clips and the like. It should also be noted that resealable closure device 60 may also enable closure of pocket 54*b* without requiring resealable closure device 62. Slits 44*b* may also be shorter than slits 44 described above as edges 48*c* and 48*d* of tabs 46*b* do not need to be folded inwardly and secured with a closure 56. As a result, slits 44*b* may be about 2 inches long and spaced apart any suitable distance from a next successive slit 44*b*.

Similar to the embodiment shown in FIG. 3, a portion 46*c* (shown in dotted line) of every second tab 46*b* may be removed so as to create a crenellated bottom edge of alternating recesses 58*c* having a bottom edge 58*d* and full tabs 46*b* having bottom edge 26*b*. Portion 46*c* may be removed from tab 46*b* at the terminus of slits 44*b*. Thus, when a weight unit 36 is placed upon full tab 46*b*, with full tab 46*b* folded upwardly as described above, the created pocket 54*b* (and weight unit 36 within) may lie generally within the same plane P' created by successive bottom edges 58*c*.

Figure 5:
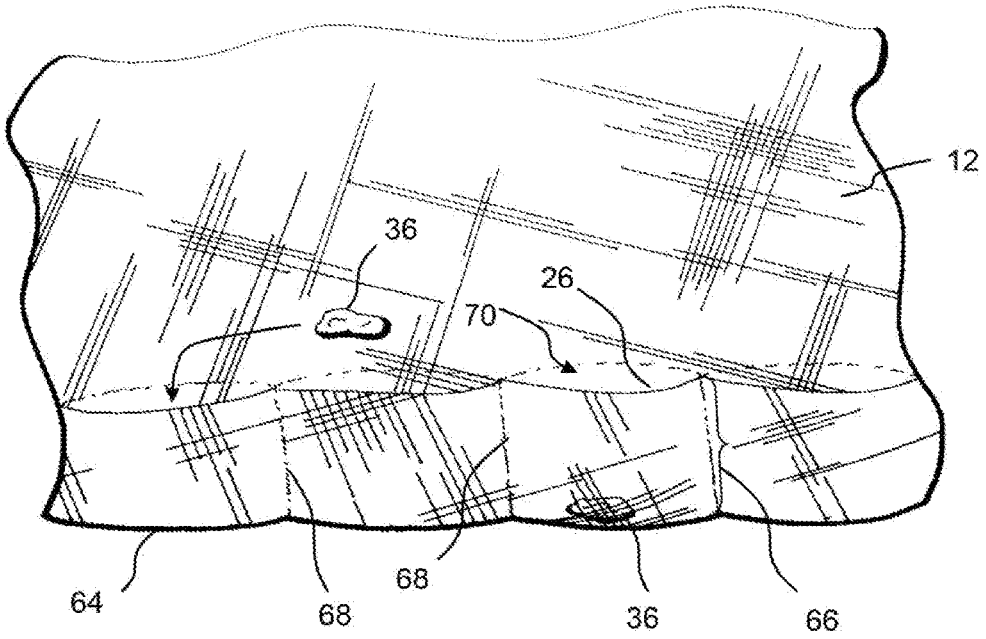
FIG. 5 is a partial expanded view of a further alternative embodiment of a bottom edge of the netting apparatus shown in FIG. 1.

Turning now to FIG. 5, an expanded view of a further alternative bottom 64 that may be used within netting apparatus 10 is shown. Bottom 64 may be formed by folding bottom edge 26 back upon a portion 66 netting 12. A plurality of spaced parallel seams 68 may be formed normal to the plane created by bottom 64 and along portion 66 so as to create a series of pockets 70 along the length of bottom 64. Each pocket is configured to removably receive a respective weight unit 36. By way of example, pockets 70 may be about 2 inches deep and any suitable dimension wide so as to accommodate weight unit 36.

Figure 6:
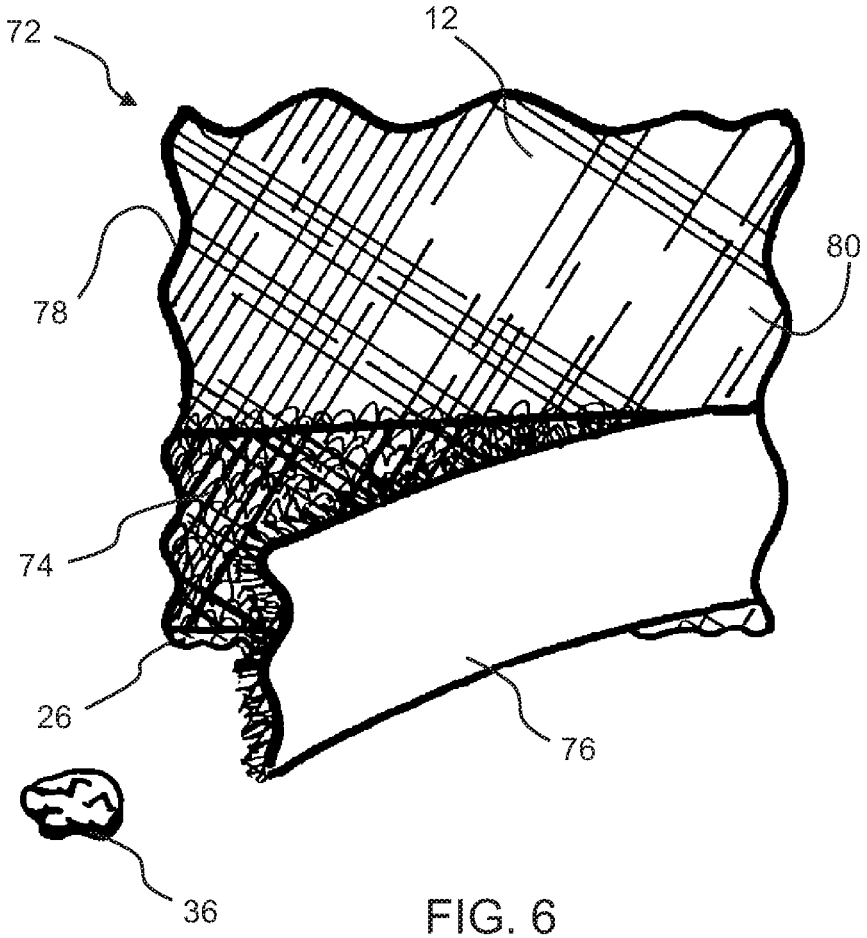
FIG. 6 is a partial expanded view of an additional alternative embodiment of a bottom edge of the netting apparatus shown in FIG. 1.

With reference to FIG. 6, an expanded view of another alternative bottom 72 is shown. Bottom 72 generally comprises bottom edge 26 of netting 12 coupled with opposing hook material 74 and loop material 76. Hook material 74 may be situated along one face 78 of netting 12 and may pass through holes contained within the netting material. Hook material 74 may be situated on the opposing face 80 of netting 12 and couple with and releasably engage with loop material 76 thereby securing bottom edge 26 of netting 12 therebetween. Hook-and loop material 74, 76 may be one to three inches wide and may encircle the entire perimeter of bottom edge 26 (see FIG. 1). Alternatively, smaller swatches of hook-and loop material 74, 76 (such as, but not limited to, 3 inch by 3 inch squares) may be selectively positioned at various locations about bottom edge 26. Hook-and-loop material 74, 76 may, itself, comprise a weight unit, or if needed, respective weight units 36 may also be selectively removably positioned between the opposing fabrics of the hook-and-loop material so as to provide additional weight to bottom edge 26. Weight units 36 may be removably positioned between either material 74, 76 and its respective netting face 78, 80.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A netting apparatus configured to create an enclosure when mounted upon an opened canopy of an umbrella, the netting apparatus comprising:

a length of netting having a top opening defined by a top edge and a bottom opening defined by a bottom edge, the length sufficient to extend from a portion of the opened canopy to substantially near the ground; the top edge including a drawstring to cinch the top edge thereby configuring the top opening to have a smaller diameter than the opened canopy; the bottom edge including a plurality of spaced parallel slits cut normal to the bottom edge to thereby create a plurality of adjacent tabs of netting, each respective tab of netting formable to create a pocket configured to removably receive a respective weight unit when the netting apparatus is mounted upon the opened canopy so as to place the bottom edge substantially near the ground and thereby create the enclosure, the netting apparatus configured to have the respective weight units removed from the netting apparatus when the netting apparatus is not mounted to the opened canopy of the umbrella.

2. The netting apparatus of claim 1 wherein the pocket is configured to be secured in a closed position using a closure when the weight unit is within the pocket.

3. The netting apparatus of claim 1 wherein the closure is selected from the group consisting of a tie, a twist tie, a rubber band, a cord lock, an adhesive tape and a hook-and-loop fastener band.

4. The netting apparatus of claim 1 wherein at least a portion of the tab includes a resealable closure device, the resealable closure device configured to secure the pocket in a closed position when the weight unit is within the pocket.

5. The netting apparatus of claim 4 wherein the resealable closure device is selected from the group consisting of a hook-and-loop material, a self-adhesive material, magnets, buttons, zippers, snaps and clips.

6. The netting apparatus of claim 1 wherein every second tab is cut parallel to the bottom edge about one-half up the length of its respective slit so as to form a crenellated series of alternating recesses and full tabs of netting, each respective full tab of netting formable to create the pocket configured to removably receive the respective weight unit.

7. The netting apparatus of claim 1 wherein the drawstring includes a cord lock to cinch the top end.

8. The netting apparatus of claim 1 wherein a portion of the netting includes a seam defining an opening releasably joined together by a fastener.

9. The netting apparatus of claim 8 wherein the seam is configured to be located within the webbing proximate a user's arm.

10. The netting apparatus of claim 8 wherein the fastener is selected from the group consisting of: a button, a zipper, hook-and-loop, magnets, snaps, clips or ties.

11. The netting apparatus of claim 8 wherein the opening is not coterminous with either the top edge or the bottom edge.

12. A netting apparatus configured to create an enclosure when mounted upon an opened canopy of an umbrella, the netting apparatus comprising:

a length of netting having a top opening defined by a top edge and a bottom opening defined by a bottom edge, the length sufficient to extend from a portion of the opened canopy to substantially near the ground, a portion of the netting including a seam defining an opening releasably joined together by a fastener; the top edge including a drawstring to cinch the top edge thereby configuring the top opening to have a smaller diameter than the opened canopy; the bottom edge crenellated so as to form a series of alternating recesses and tabs of netting, each respective tab of netting formable to create a pocket configured to removably receive a respective weight unit when the netting apparatus is mounted upon the opened canopy so as to place the bottom edge substantially near the ground and thereby create the enclosure, the netting apparatus configured to have the weight units removed from the netting apparatus when the netting apparatus is not mounted to the opened canopy of the umbrella.

13. The netting apparatus of claim 12 wherein the fastener is selected from the group consisting of: a button, a zipper, hook-and-loop, magnets, snaps or ties.

14. The netting apparatus of claim 12 wherein the opening is not coterminous with either the top edge or the bottom edge.

* * * * *